US006968621B1

(12) United States Patent
Steinberg

(10) Patent No.: US 6,968,621 B1
(45) Date of Patent: Nov. 29, 2005

(54) DEVICE FOR REMOVAL AND REPLACEMENT OF ROTARY SHAVER CUTTING ELEMENTS

(76) Inventor: Hy Steinberg, 9646 W. McNab Rd., Tamarac, FL (US) 33321

( * ) Notice: Subject to any disclaimer, the term of this patent is extended or adjusted under 35 U.S.C. 154(b) by 0 days.

(21) Appl. No.: 11/108,464

(22) Filed: Apr. 19, 2005

(51) Int. Cl.[7] ..... B26B 19/14

(52) U.S. Cl. ..... 30/43.6; 30/346.51

(58) Field of Search ..... 30/43.6, 346.54, 30/43.5, 537, 539

(56) References Cited

U.S. PATENT DOCUMENTS

| | | | | |
|---|---|---|---|---|
| 2,677,884 | A * | 5/1954 | Richard | 30/43.6 |
| 3,233,323 | A * | 2/1966 | Driessen | 30/43.2 |
| 3,399,453 | A * | 9/1968 | Biesma | 30/43.6 |
| 4,087,909 | A * | 5/1978 | Naemura | 30/43.6 |
| 4,926,550 | A * | 5/1990 | Geertsma et al. | 30/43.1 |
| 5,012,577 | A * | 5/1991 | Bosch | 30/43.6 |

* cited by examiner

*Primary Examiner*—Douglas D Watts

(57) ABSTRACT

A device for the simultaneous removal and replacement of a plurality of sharp cutting elements in a rotary electric shaver without touching them or transposing their respective pinion positions.

7 Claims, 1 Drawing Sheet

CROSS-SECTION A-A

DEVICE FOR REMOVAL AND REPLACEMENT OF ROTARY SHAVER CUTTING ELEMENTS

BACKGROUND OF THE INVENTION

Field of the Invention

The invention pertains to rotary shavers with a plurality of removable cutting elements attached to drive pinions without an intervening framework.

SUMMARY OF THE INVENTION

The preferred embodiment of the invention is a simple device that can be placed over drive pinions in a rotary shaver's head to simultaneously remove a group of circular cutting elements from their pinions and retain their relative positions while they are brushed clean, washed under a faucet or bathed in a sterilizing fluid. The cutting elements are returned to their pinions by placing the device over the shaver's head and simultaneously releasing them. All cleaning operations and cutting element replacement can be accomplished rapidly and without touching the razor-sharp edges of the cutting elements. The increased safety and reduced time for cleaning permits rotary shavers with sharp cutting elements to compete more effectively against other shavers.

The described device can be packaged with replacement cutting elements or packaged as an accessory with new shavers. It can also be a removable part of the shaver, to be discarded whenever new cutting elements are installed.

DETAILED DESCRIPTION OF THE INVENTION

The majority of multi-headed rotary electric shavers marketed world-wide have drive spindles that connect to their circular cutting elements either directly, or indirectly through an intervening, locked framework. In both arrangements, cleaning the circular cutting elements after shaving is very time consuming and problematic, particularly if each cutting element must be returned to its original position within the shaver head to assure the continued efficiency of the shaver. Some models of shavers with an intervening framework have an isolated head compartment that permits cleaning fluid to penetrate the framework and cutters to remove hair residues. This is only a half-measure because without the firm brushing of surfaces, fluid circulation by itself cannot remove all of the accumulated oils and caked hair residues.

The rotary shavers that have cutting elements connected directly to their drive spindles, without a complex intervening framework, have the advantage of easy access for cleaning. However, the exposed, sharp cutting elements of such shavers are unsafe for the user to handle. Each cutting element either consists of a metal stamping with peripheral projections that are ground to razor sharpness or it consists of a number of small razor blades that are embedded and suspended upright within a circular plastic button. In either case, the exposed sharp edges on the top surface of the circular cutting element pose a safety hazard for the user. In practice, the user must grip the individual cutting element tightly around its sharp edges to pull it up and remove it from its drive pinion, then grip it firmly for brushing or rinsing and, finally, push it down forcefully to replace it on its pinion. Unless the user is adept and very careful in performing these operations, the result is likely to be a punctured or cut finger. Furthermore, during cleaning, the removal of more than one cutting element at a time increases the likelihood that the cutting elements will not be returned to their original pinions, thereby reducing the shaver's efficiency.

The embodiments of this invention eliminate the disadvantages and hazards of rotary shavers with circular, sharp cutting elements that are directly and removably connected to their drive pinions within the shaver's head. The devices illustrated herein, enable the user to simultaneously remove all of the sharp cutting elements as a group, brush them, rinse them under a faucet, or soak them in a disinfectant solution and then return them to their original pinion positions, without touching them. The device can be packaged with new shavers as an accessory, or packaged and sold separately with a replacement set of cutting elements. It can also be configured as a removable part of the shaver that can be discarded when a set of new cutters are installed.

Figure 1:
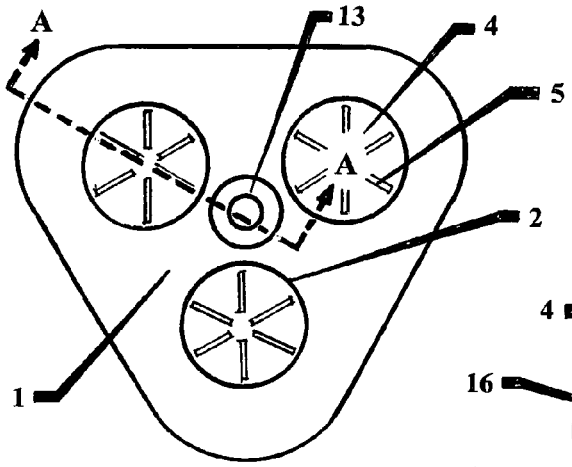
FIG. 1 is a top view of a preferred embodiment of the invention, illustrating the cutting element positions when they are held in the cavities of the device.

FIG. 1 is a top view showing the construction of a preferred embodiment of the invention. The horizontal plate (1) has circular cavities (2) spaced equidistantly around a central aperture (3) (see FIG. 3) and the perimeter of plate (1) is triangular to fit a triple-headed rotary shaver, but it can be circular to fit the head of a planetary rotary shaver described in U.S. Pat. No. 6,553,668 or shaped to fit any other rotary shaver with a plurality of cutting heads. Each cavity (2) securely holds a circular cutting element (4) and permits its sharp edges (5) to be exposed for brushing as well as the flow of water or cleaning fluid that drains through the bottom opening of cavity (2).

Figure 2:
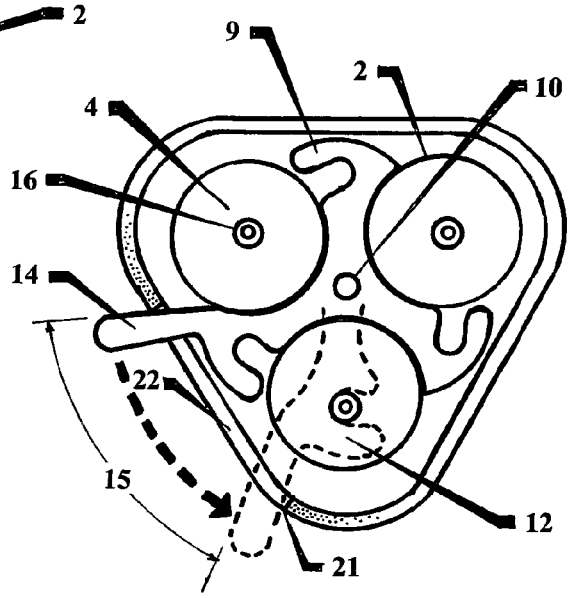
FIG. 2 is a bottom view of a simplified embodiment of the invention, illustrating the rotatable cam in fully-opened and fully closed positions.
Figure 3:
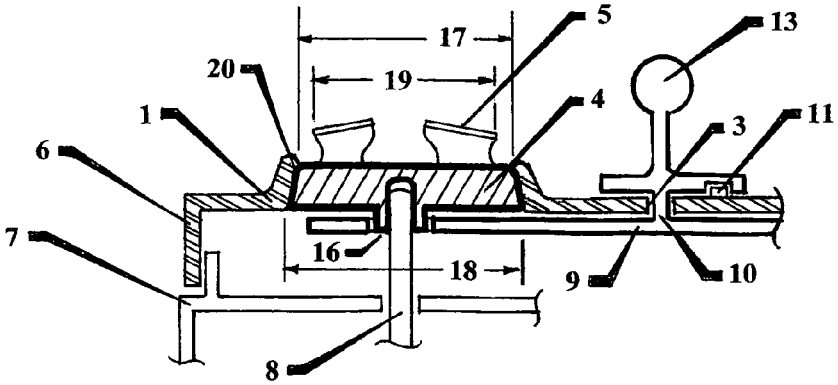
FIG. 3 is a partial cross-section of the preferred embodiment of FIG. 1, illustrating the assembly and connective relationship of all parts of the device.

FIG. 3 is the partial cross-section A—A (FIG. 1), wherein the rim (6) of plate (1) may be extended downward to form a cap that fits over the outer edge (7) of the shaver's head and assures alignment of the cutting elements (4) prior to engagement with the drive pinions (8). The cam (9) is fixed to the central axis (10) of the turn knob (13) and has contoured, radial arms (9) (FIG. 2) that rotate simultaneously about the central axis (10). The angle of cam rotation, clockwise or counterclockwise can be restricted by detents or pins (11) between the plate (1) and the cam (9) or knob (13) so that the cam arms simultaneously surround the stems (16) and block the undersides of all cavity openings (2) or simultaneously unblock the undersides of all cavity openings (2), depending on the direction that the knob (13) is turned. When the plate (1) is lowered over the head of the shaver, with the cam in the unblocked position, the cutting elements (4) freely move up through the wider, bottom diameters (18) of the cavity openings and are retained in the cavities by the narrower, upper diameters (17) of the cavity openings. The vertical inner surface (20) of the cavity opening is contoured to match the outer vertical surface of the cutting element (4) to assure a loose fit between the two circular surfaces. When the plate (1) is removed, the cutting elements (4) are simultaneously lifted off their pinions (8) and contained within the plate (1). Because the outermost diameter (19) of the sharp edges (5) of the cutting element is less than the diameter (17) of the top opening: of the cavity, all of the sharp edges (5) of the cutting elements protrude above the top opening of the cavity and can be brushed easily. The entire device, including the cutting elements, can also be rinsed under a running faucet or soaked in a container of alcohol or disinfectant fluid. After removal from the water or disinfectant, all liquids will drain from the cavities and the device can be air-dried, if desired. The cutting elements can be returned to their original pinion positions by placing the plate (1) over the shaver's head, turning the knob (13) to the open position and withdrawing the emptied device.

FIG. 2 is a bottom view of another version of the preferred embodiment that eliminates the turning knob (13) (see FIG. 3) at the top of the device. Instead of the knob, one of the cam arms (14) is extended outside the perimeter of the plate (1) through a slot opening (22) in the side of the plate (1). This arm (14) need only protrude slightly from the plate (1) and can have a knurled end for easy movement by the user's finger or thumb. The intersections (21) between the extended arm (14) and each end of the slotted opening (22) can be provided with tactile resistance to indicate a fully-opened or a fully-closed position of the cam. The restricted angle of rotation (15) for the cam (9) will vary for different rotary shaver head designs and will depend upon the number and diameters of the cutting elements in the shaver's head, their distance from their central axis and the specific contour of the radial arms of the cam. This particular embodiment of the invention permits the device to be incorporated as an original but removable part of the shaver.

Figure 4:
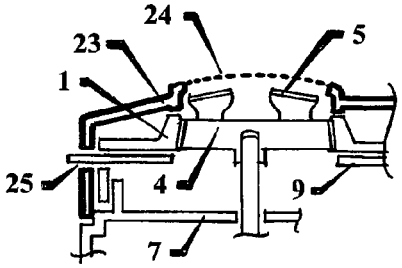
FIG. 4 is a sectional diagram showing the simplified embodiment of FIG. 2 as a removable part of the shaver, with the outer screen cap in place over it.

FIG. 4 is a diagrammatic illustration of how the embodiment of the invention shown in FIG. 2 can be integrated as a removable part of the shaver. The plate (1) is sandwiched between the top portion (7) of the rotary shaver and the conventional, removable outer cap (23) that has perforated screens (24) covering the shaver's rotating elements (4) and cutting edges (5). The outer cap (23) can have a narrow slot opening (25) which would permit the cam extension (14) (FIG. 2) to protrude and be held in its open, unblocked cavity position. When the shaver is in use, the cam (9) would not inhibit the normal rotation of the cutting elements (4).

The illustrated features of the preferred embodiments of this invention are not intended to limit or exclude variations in design or configuration that expand their use or market acceptability.

What is claimed is:

1. A device for simultaneously inserting or extracting and holding a plurality of circular cutting elements that are removable connected to drive spindles in a rotary electric shaver, comprising;

a flat plate for surrounding and holding the cutting elements, said plate having circular, open cavities spaced equidistantly around a central plate aperture; and a horizontally rotatable cam fixed to the underside of said plate by a vertical axel within said aperture, said cam having radially extending arms that are contoured to surround the spindle connection areas beneath the cutting elements when its arms are rotated into position for lifting and removing the cutting elements from their spindles, said arms being further contoured to vacate all cavity openings when rotated, in an opposite direction, prior to placing the device over the cutting elements to remove them or after returning the cutting elements to their spindles.

2. A device according to claim 1, wherein the circular, vertical inner surfaces of said cavity openings are contoured to match the vertical, outer surface contours of said cutting elements.

3. A device according to claim 1, wherein said cam is rotatable to either its fully open or its fully closed cavity position by means of a turning knob that is fixed to said central axis and is located on the top surface of said plate.

4. A device according to claim 3, wherein projecting pin inserts and matched detents between said plate and said knob or said cam are positioned to limit the rotation angle of said knob between the fully open cavity and the fully closed cavity positions of the cam.

5. A device according to claim 1, wherein the peripheral edge of said plate, or a portion thereof, extends vertically downward to form a removable, alignment cap that fits over the exterior top edge of the rotary shaver.

6. A device according to claim 5, wherein at least one of the radially extending arms of said cam protrudes outside of said alignment cap through a slotted opening in said cap, said opening being parallel to and within the plane of said cam and having a width that confines the rotary movement of said cam between its fully open position and its fully closed cavity position.

7. A device according to claim 1, wherein the inside diameter of each cavity opening on the underside of said plate is equal to or greater than the outside base diameter of the cutting element in the shaver's head and wherein the inside diameter of each cavity opening on the top surface of said plate is greater than the diameter of the outermost cutting edges of the cutting element but less than the outside base diameter of the cutting element.

* * * * *